US009267191B2

(12) United States Patent
Raykhtsaum

(10) Patent No.: US 9,267,191 B2
(45) Date of Patent: Feb. 23, 2016

(54) REVERSIBLY AGE HARDENABLE, PALLADIUM CONTAINING TARNISH RESISTANT STERLING SILVER ALLOYS

(71) Applicant: RICHLINE GROUP, Inc., New York, NY (US)

(72) Inventor: Grigory Raykhtsaum, Sharon, MA (US)

(73) Assignee: Richline Group, Inc., New York, NY (US)

( * ) Notice: Subject to any disclaimer, the term of this patent is extended or adjusted under 35 U.S.C. 154(b) by 124 days.

(21) Appl. No.: 14/045,394

(22) Filed: Oct. 3, 2013

(65) Prior Publication Data

US 2014/0127075 A1 May 8, 2014

Related U.S. Application Data

(60) Provisional application No. 61/722,824, filed on Nov. 6, 2012.

(51) Int. Cl.
*C22C 5/06* (2006.01)
*C22C 5/08* (2006.01)

(52) U.S. Cl.
CPC .... *C22C 5/06* (2013.01); *C22C 5/08* (2013.01)

(58) Field of Classification Search
CPC ..... C22C 5/06; C22C 5/08; C22C 5/10
See application file for complete search history.

(56) References Cited

U.S. PATENT DOCUMENTS 1,628,673 A † 5/1927 Leach
4,494,833 A * 1/1985 Takamura ..... G02C 5/00 351/117
4,810,308 A 3/1989 Eagar et al.
4,869,757 A 9/1989 Eagar et al.
4,973,446 A † 11/1990 Bernhard
5,037,708 A * 8/1991 Davitz ..... 428/673
5,039,479 A 8/1991 Bernhard et al.
5,171,643 A 12/1992 Suzuki et al.
5,558,833 A 9/1996 Zamojski
5,817,195 A 10/1998 Davitz
5,882,441 A 3/1999 Davitz
6,406,664 B1 6/2002 Diamond
6,726,877 B1 4/2004 Eccles
6,841,012 B2 1/2005 Croce
6,860,949 B1 3/2005 Weber
7,118,707 B2 10/2006 Robinson
7,128,792 B2 10/2006 Menon
7,128,871 B2 10/2006 Davitz
7,198,683 B2 * 4/2007 Agarwal et al. ..... 148/431
8,136,370 B2 3/2012 Bennett
8,771,591 B1 7/2014 Bennett
2008/0069722 A1 * 3/2008 Johns ..... 420/504
2013/0112322 A1 † 5/2013 Butler

FOREIGN PATENT DOCUMENTS

JP 58104137 A * 6/1983
JP 2002146453 A * 5/2002
WO WO 2012/125516 A2 * 9/2012 ..... C22C 5/06

* cited by examiner
† cited by third party

*Primary Examiner* — Scott Kastler
*Assistant Examiner* — Vanessa Luk
(74) *Attorney, Agent, or Firm* — Gottlieb, Rackman & Reisman, P.C.

(57) ABSTRACT

A silver-based alloy composition which is soft and workable in an annealed condition, is hardenable through heat treatment, and is tarnish resistant. The preferred embodiment of the composition of the present invention includes a small percentage of palladium and a reduction from typical percentages of copper found in a sterling silver alloy. In one embodiment the silver-based alloy includes no copper at all.

11 Claims, 4 Drawing Sheets

Color change measured at the end of three different sessions for each sample.

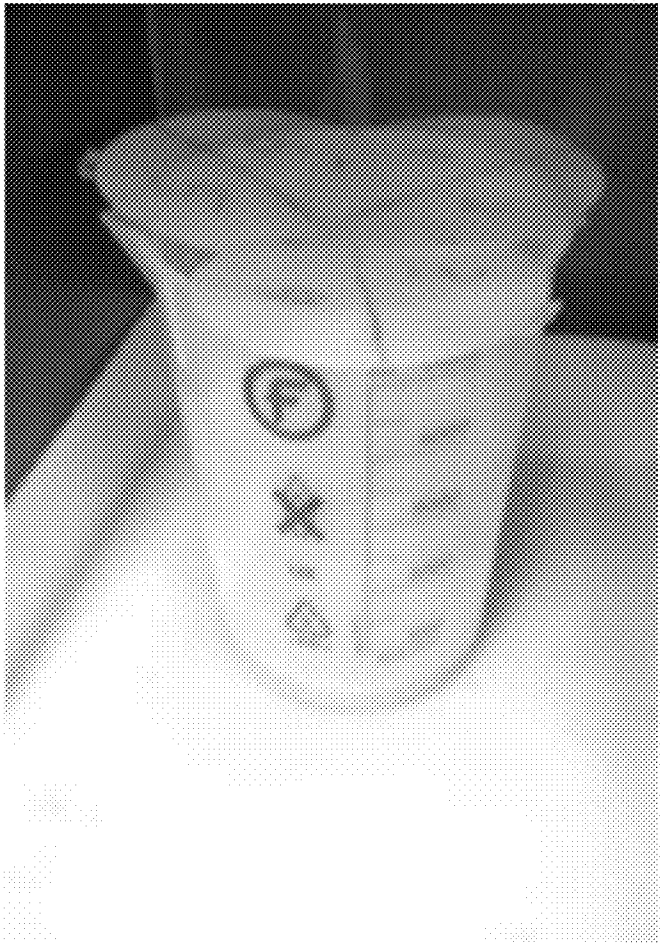
FIG. 1. Tarnish set up

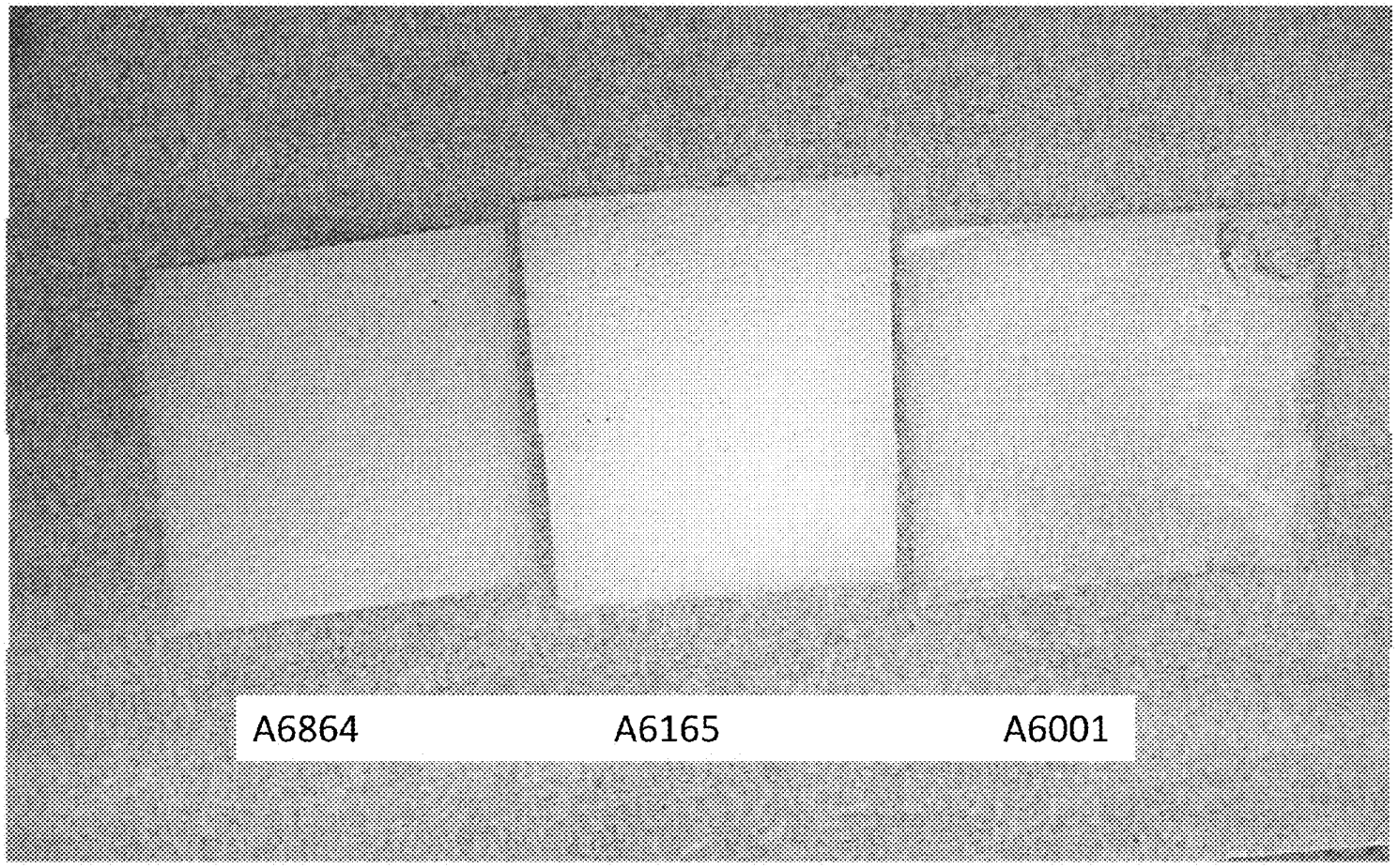
FIG. 2. After tarnish test samples covered with tissue to reduce high reflectivity.

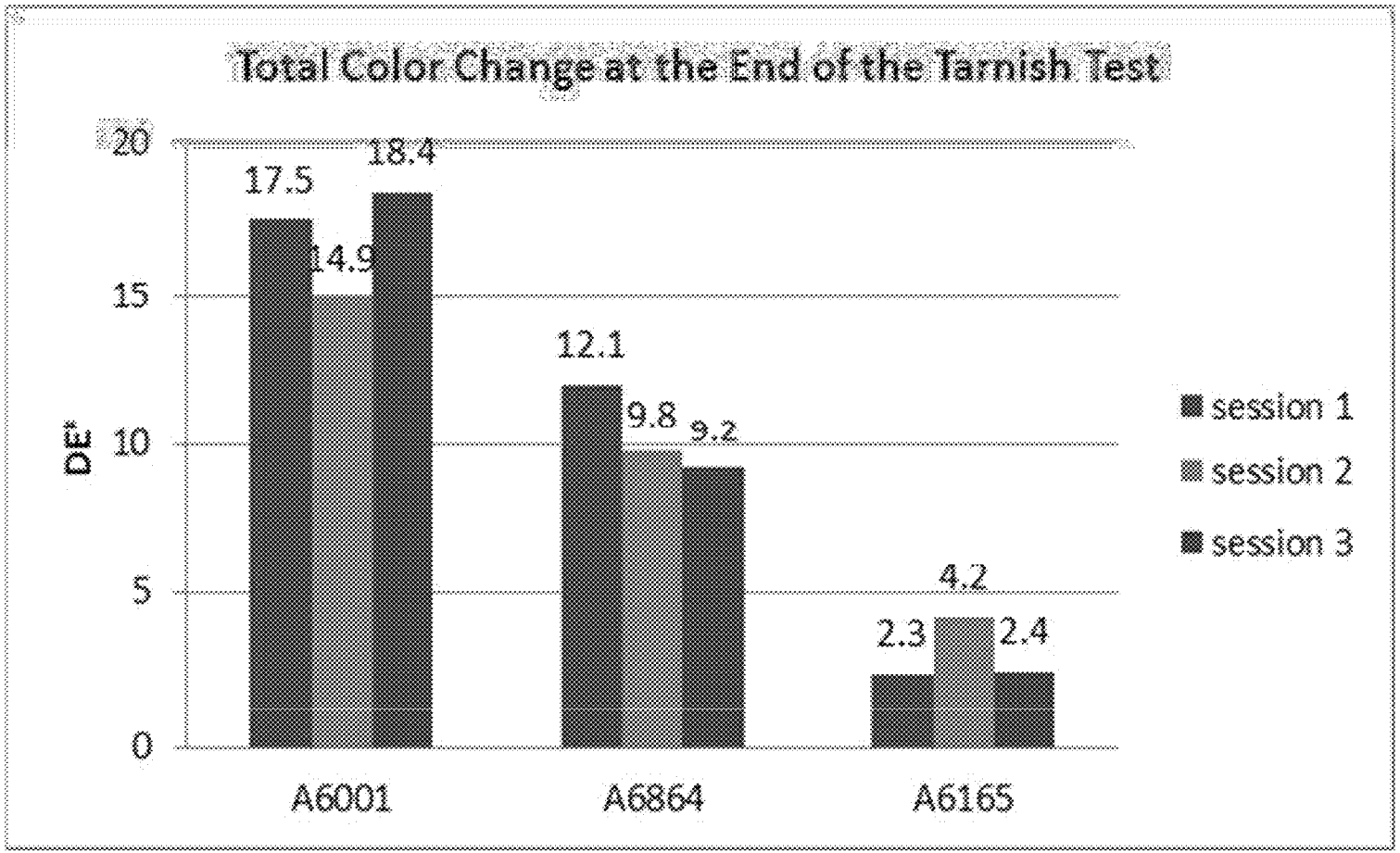
FIG. 3. Color change measured at the end of three different sessions for each sample.

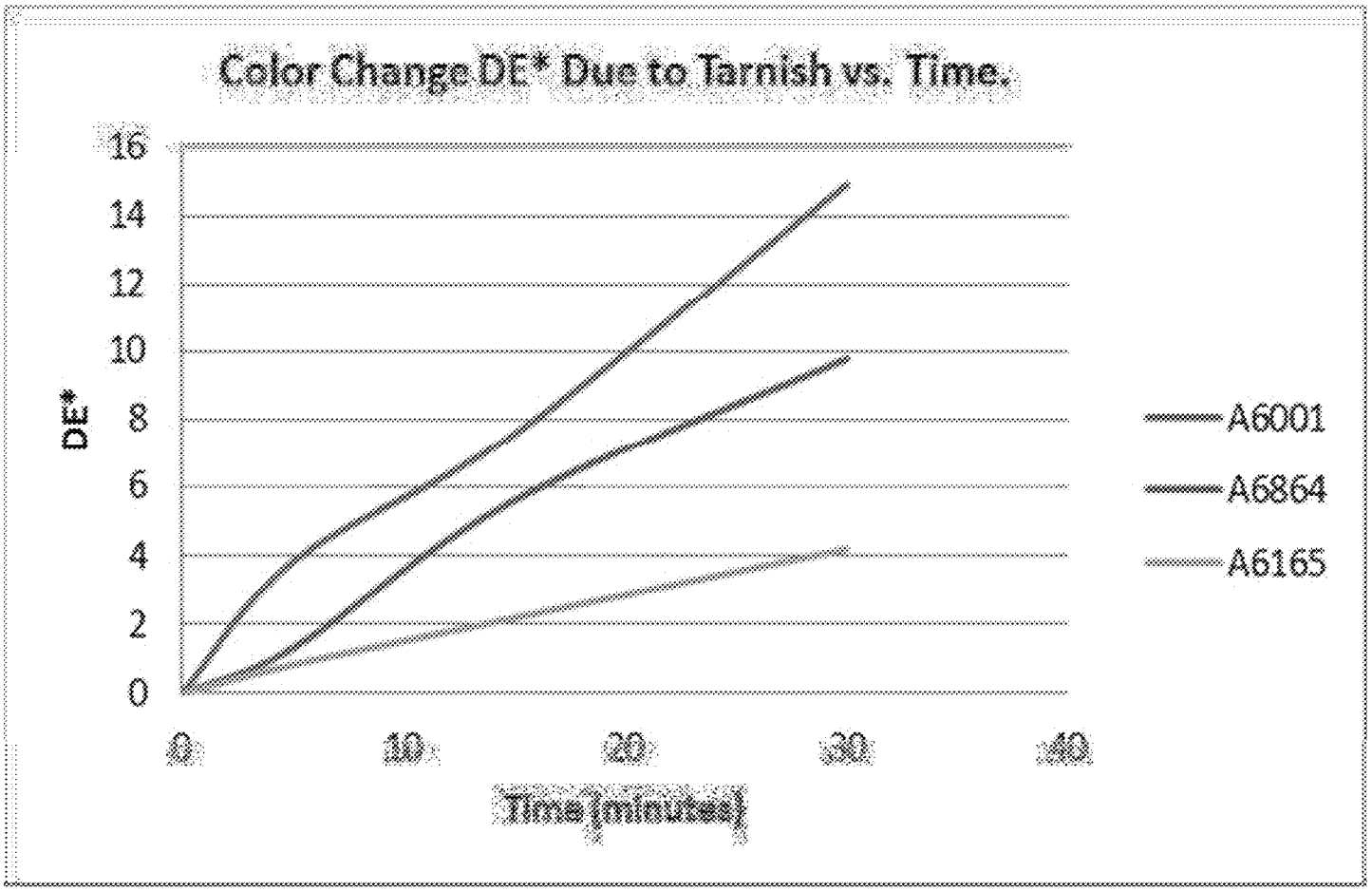
FIG. 4. Tarnish curves – Color change during tarnish test.

REVERSIBLY AGE HARDENABLE, PALLADIUM CONTAINING TARNISH RESISTANT STERLING SILVER ALLOYS

The present application claims priority to U.S. Provisional Pat. Application No. 61/722,824, filed on Nov. 6, 2012, and which is incorporated herein by reference.

BRIEF DESCRIPTION OF THE PRESENT INVENTION

The present invention relates to compositions of hardenable and tarnish resistant sterling silver alloys to be used for jewelry manufacturing, among other purposes. The invention is directed to an alloy used for traditional sterling silver jewelry manufacturing scenarios. The alloy is soft and workable in its annealed condition, and can be hardened by heat treatment after forming or casting. The alloy of the present invention exhibits an outstanding resistance to tarnish. In particular, in one embodiment of the present invention, small amounts of palladium are introduced in a silver-copper alloy. In other embodiments, other metals, such as zinc, boron, as well as non-metals, such as silicon, are introduced in various quantities and combinations.

The present invention is further directed to a silver-based alloy composition which is soft and workable in an annealed condition, is hardenable through heat treatment, and is tarnish resistant. The preferred embodiment of the composition of the present invention includes a small percentage of palladium and a reduction from typical percentages of copper. In one embodiment the silver-based alloy includes no copper at all.

BACKGROUND OF THE PRESENT INVENTION

The classic sterling silver as we know it since medieval times comprises 92.5% silver and 7.5% copper by weight. It is known to be an easily tarnishable alloy. Its hardness in a soft annealed condition is known to be about 60 Vickers, and can be reversibly increased by age hardening typically up to about 110 Vickers. It is known that classic sterling silver age hardens due to a silver-copper miscibility gap. It is also known that silver-copper alloys show practically no age hardening when the concentration of copper is below about 5% by weight. It is not unusual for the modern sterling silver alloys to contain certain other base metals besides copper including tin, zinc, and indium. There are numerous sterling silver alloys that are commercially available and are described in literature. Some of these alloys are designed to improve casting characteristics such as form-filling and fluidity. Some of these alloys claim such features as higher as cast hardness, ability to be hardened by heat treatment (reversible hardenability) and high tarnish resistance.

U.S. Pat. Nos. 4,810,308 and 4,869,757 teach alloys with the small additions of tin and lithium that increase the aged hardness of sterling silver up to about 156 Vickers. The tarnish behavior of such alloys, however, is similar to that of classic sterling silver.

The resistance to tarnish of sterling silver alloys can be improved by lowering the copper content and adding other elements as shown in the examples below. The annealed hardness of these alloys lies within the range between 60-80 Vickers. Some of these alloys may be age hardened up to 135 Vickers.

Other relevant U.S. patents include:

- U.S. Pat. No. 4,973,446 teaches low copper alloys that have an improved tarnish resistance. These alloys are soft and can not be age hardened.
- U.S. Pat. Nos. 5,037,708 and 8,136,370 describe low tarnish silver alloys that contain from 4% to 15% by weight palladium. These alloys also contain from 0.5% to 1.75% by weight indium and/or zinc. Although, these patents do not teach such alloys with age hardening characteristics, they are most likely age hardenable due to Pd—Cu order-disorder transformation. A fairly high content of palladium significantly increases the cost of these alloys.
- U.S. Pat. No. 5,039,479 describes palladium-free low tarnish alloys. These alloys typically do not show an appreciable age hardening.
- U.S. Pat. No. 5,171,643 teaches electrical contact silver material that contains from 0.1% to 1.0% palladium by weight. Additions of palladium in these alloys are small, and do not contribute to age hardening.
- U.S. Pat. No. 5,558,833 teaches silver-indium based alloys that are palladium-free and soft.
- U.S. Pat. No. 5,817,195 describes high zinc, and low copper and nickel silver alloy compositions where nickel is within the range 0.25%-0.5% by weight. Such levels of nickel may cause allergenic skin reactions.
- U.S. Pat. No. 5,882,441 palladium-free low tarnish alloy that is soft due to low copper content.
- U.S. Pat. No. 6,406,664 describes palladium-free alloys. The resistance to tarnish in these alloys is achieved by additions of germanium. The hardness of these alloys is similar to that of the classic sterling silver.
- U.S. Pat. No. 6,726,877 teaches another germanium-containing alloy that is palladium-free.
- U.S. Pat. No. 6,841,012 describes anti-tarnish silver alloy with the additions of numerous elements except palladium.
- U.S. Pat. Nos. 6,860,949 and 7,118,707 teach tarnish resistant platinum containing silver alloys. The hardness of such alloys is expected to be similar to that of the classic sterling silver. These alloys contain no palladium.
- U.S. Pat. Nos. 7,128,871 and 7,128,792 teach another palladium-free silver alloys with low copper content. These alloys are soft and may not show reversible age hardening.
- U.S. Pat. No. 7,198,683 describes tarnish resistant and age hardenable alloy. It contains no palladium.

BRIEF DESCRIPTION OF THE FIGURES

FIG. 1 is a photograph of the tarnish test set up of the present invention.

FIG. 2 is a photograph of covered tarnish test samples.

FIG. 3 is a chart showing color change measured at the end of three different sessions for each sample.

FIG. 4 is a chart showing color changing during the tarnish test.

DETAILED DESCRIPTION OF THE PRESENT INVENTION

An objective of the present invention is to improve both the tarnish resistance and reversible hardness of a silver-based alloy used for jewelry by introducing small amounts of palladium and zinc, at times, in combination with or in lieu of copper, and doing so at reasonable cost. In the preferred embodiment, the improved compositions consist of the following parts by weight: at least 92.5% silver, about 2% to 3% palladium, about 1% to 1.5% zinc, 0% to 0.1% silicon (as the de-oxidizer), 0% and 0.02% boron (to enhance the alloy fluidity), and the balance copper. Although palladium is introduced, the percentage of palladium remains low because the more palladium that is added, the most expensive the alloy becomes. In the present invention, no more than 5% of the alloy is palladium and preferably, less than 4% is palladium and even more preferably, 3% or less is palladium.

Table 1 lists different compositions, including traditional sterling silver (alloy 1) and example alloy compositions of the present invention (alloys 2-5), and including each composition's as cast Vickers hardness $VH_{as\ cast}$, hardness after heat treatment $VH_{ht}$, and CIELab color coordinates L* (brightness), a* (red-green) and b* (blue-yellow), including traditional sterling silver (alloy 1) and for the alloys of the present invention 2-5, measured using conditions identified in well-known ASTM methods. Each of compositions 2-5 provides some or all of the desired characteristics. It is clear that the alloys of the invention show very similar to regular sterling color and exceptionally good reversible hardness between 160 and 180 Vickers (as opposed to 110 Vickers for regular sterling and 130 for existing hardenable silver alloys).

TABLE 1

| Alloy | % Ag | % Pd | % Cu | % Zn | % Si | % B | VH as cast | VH ht | L* | a* | b* |
|---|---|---|---|---|---|---|---|---|---|---|---|
| 1 | 92.5 | — | 7.5 | | | | 85 | 110 | 94.5 | −0.3 | 5.2 |
| 2 | 92.5 | 3 | 3 | 1.5 | | | 85 | 160 | 92.6 | 0 | 4.7 |
| 3 | 92.5 | 2 | 4.0 | 1.5 | | | 115 | 180 | 93.3 | −0.3 | 4.7 |
| 4 | 92.5 | 2 | 4.5 | 1.0 | | | 105 | 175 | 92.6 | −0.2 | 4.7 |
| 5 | 92.5 | 2.5 | | 1.0 | 0.035 | 0.01 | 115 | 180 | 93.0 | −0.3 | 4.7 |

The alloys of the invention (alloys 2 through 5) each also show superior tarnish resistance. During a tarnish test, a sample of which is detailed as FIG. 1, in the vapor of ammonium sulfide when the regular sterling silver color change DE* is about, and the commercially available (conformant with ASTM methods) low tarnish silver DE* is about 10, the DE* of the alloys of the invention is just 3.

With regard to the use of the composition in jewelry making, typically the composition of the present invention is annealed at 1350° F. and water quenched. The composition is age hardened at approximately 700° F. for at least one hour. As cast, the annealed hardness is from 85-115 Vickers and following age hardening, the hardness is from 160-180 Vickers.

Tarnish Testing

We have conducted comparative tarnish rest of three samples: Regular sterling A6001; LG422 sterling A6864 the tarnish behavior of which is comparable with many commercially available "de-ox" silvers; and A6165 new palladium containing sterling alloy #484. The results confirm superior tarnish resistance of new #484 alloy. This report provides the test details and presents the quantitative results.

Sample Preparation 1.5" long and 0.020" thick samples were cut out from the annealed flat stock items:

Regular sterling: A6001-020-1.750-S

LG422: A6864-020-1.468-S

#484 Pd-sterling: A6165-020-1.697-S

One side of each sample was manually polished and then carefully washed in acetone and alcohol to remove any polishing compound residues.

Tarnish Test Conditions 15 drops (about 0.75 ml) of ammonium sulfide $(NH4)_2S$ were combined with 250 ml of water. This solution was transferred into the 3 liter plastic beaker. The samples were placed polished sides up on the perforated plastic cover on top of the beaker about 9" above the solution as shown in FIG. 1. The color change as a function of time was observed visually as well as measured using color spectrophotometer. FIG. 2 shows an example of visual observation using the tissue to diffuse highly reflected light. FIG. 2 shows after tarnish test samples which are covered with tissue to reduce high reflectivity. Visually, regular sterling A6001 shows the most color change due to tarnish. Commercial "de-ox" sterling A6864 shows less tarnishing. New sterling alloy A6165 shows superior tarnish resistance.

After tarnish test samples are covered with tissue to reduce high reflectivity. Visually, regular sterling A6001 shows the most color change due to tarnish. Commercial "de-ox" sterling A6864 shows less tarnishing. New sterling alloy A6165 shows superior tarnish resistance.

Quantitative Tarnish Analysis

We have conducted three independent tarnish test sessions, each included new sample preparation and new solution preparation. The color change was measured using our Macbeth color spectrophotometer. There were some uncontrolled session-to-session variations related to instability of ammonium sulfide, ambient temperature and humidity. Even though such variations may have affected the absolute measurements, the comparative tarnish behavior of the samples stayed the same. This is illustrated in FIG. 3 which is a bar chart showing color change that was measured at the end of each test in three different sessions for each sample. The color change of regular sterling varies between 14.9 and 18.4, the range of color change of LG422 is much lower between 9.2 and 12.1, and the color change of new #484 sterling has the lowest range between 2.3 and 4.2. It is evident that #484 sterling exhibits the best tarnishing behavior.

FIG. 4 shows the dynamic color change for each sample during one of the sessions. It needs to be noted that the color change of 1 is practically un-noticeable by an average human eye. The tarnish curves in FIG. 4 indicate that within first 8 minutes when the regular sterling and LG422 show noticeable tarnish (about 4.5 and 2.0 color change respectively), the color of #484 sterling alloy stays practically unchanged. As the tarnish test progresses it becomes apparent that #484 alloy shows the lowest tarnish rate.

Therefore, while various improved compositions have been shown and described, and several modifications thereof discussed, persons skilled in this art will readily appreciate that various additional changes and modifications may be made without departing from the spirit of the invention, as defined and differentiated by the following claims.

The invention claimed is:

1. A silver-based alloy composition consisting of in parts by weight:

at least 92.5% silver, 2-2.4% palladium, greater than 3.7 and no more than 5% copper, 0-0.02% boron, 0-1.5% zinc, and
0-0.1% silicon;
with at least 0.005% being boron and/or silicon,
where said composition is soft and workable in an annealed condition, is hardenable by heat treatment, and is demonstrably tarnish resistant.

2. The composition of claim 1 further consisting of 0-0.035% silicon.

3. The composition of claim 1 further consisting of 1-1.5% zinc.

4. The composition of claim 1 further consisting of less than 0.04% silicon.

5. The composition of claim 1 consisting of palladium in the range of 2-2.1%.

6. The composition of claim 1 wherein color components L*, a*, and b* are in the ranges of 92 to 93, 0 to −0.3, and 4.6 to 4.8, respectively.

7. The composition of claim 1, wherein the composition is ace hardenable at approximately 700° F. for at least one hour.

8. A silver-based alloy composition consisting of in parts by weight:
92.5-98% silver,
1-2.4% palladium,
1-1.5% zinc,
about 0.035% silicon, and
about 0.01% boron;
where said composition is soft and workable in an annealed condition, is hardenable by heat treatment, is demonstrably tarnish resistant, and is void of copper.

9. The composition of claim 8 wherein color components L*, a*, and b* are in the ranges of 92 to 93, 0 to −0.3, and 4.6 to 4.8, respectively.

10. The composition of claim 8, wherein palladium is limited to 1-2% of the composition.

11. A silver-based alloy composition consisting of in parts by weight:
92.5-98% silver,
2-2.4% palladium,
1-1.5% zinc,
about 0.035% silicon, and
about 0.01% boron;
where said composition is soft and workable in an annealed condition, is hardenable by heat treatment and is demonstrably tarnish resistant.

* * * * *